US006241240B1

(12) United States Patent
Bukhman

(10) Patent No.: US 6,241,240 B1
(45) **Date of Patent: *Jun. 5, 2001**

(54) CASSETTE FOR STACKING BANKNOTE

(75) Inventor: Sergey Bukhman, Kiev (UA)

(73) Assignee: Cashcode Company Inc., Concord ( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/118,881

(22) Filed: Jul. 20, 1998

(51) Int. Cl.[7] ..... B65H 29/44; B65H 29/46

(52) U.S. Cl. ..... 271/214; 271/181; 271/214; 271/213; 271/219; 271/209

(58) Field of Search ..... 271/180, 181

(56) References Cited

U.S. PATENT DOCUMENTS 5,564,691 10/1996 Tadashi .

FOREIGN PATENT DOCUMENTS

57081050 * 5/1982 (JP) .
62-290671 * 12/1987 (JP) .

OTHER PUBLICATIONS

Patent Abstracts of Japan vol 012, No. 179 (M–701) May 26, 1988 –& JP 62 290671 A (Fuji Electric Co. Ltd.) Dec. 17, 1987 abstract; figures.

Patent Abstracts of Japan vol. 006 No. 167 (M–153) Aug. 31, 1982—JP 57 081050 A (Fuji Electric Co. Ltd.), May 20, 1982 abstract.

Patent Abstracts of Japan vol. 008, No. 170 (M–315), Aug. 7, 1984—& JP 59 064469 (Fujitsu KK), Apr. 12, 1984 abstract.

* cited by examiner

*Primary Examiner*—Donald P. Walsh
*Assistant Examiner*—Jonathan R Miller

(57) ABSTRACT

A cassette for receiving and storing banknotes advantageously uses a movable guide in combination with a movable actuator which each move toward the other for stripping of a banknote received in the guide and adding the stripped banknote to a stack of banknotes.

15 Claims, 5 Drawing Sheets

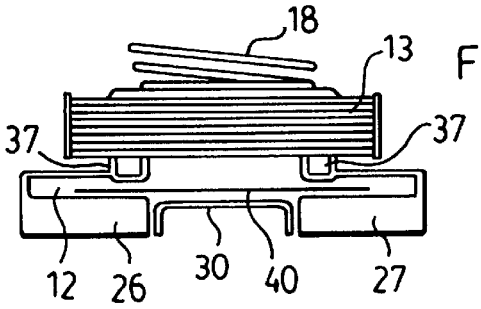
FIG. 2.
FIG. 3.
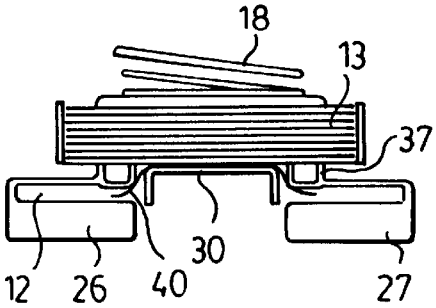
FIG. 4.
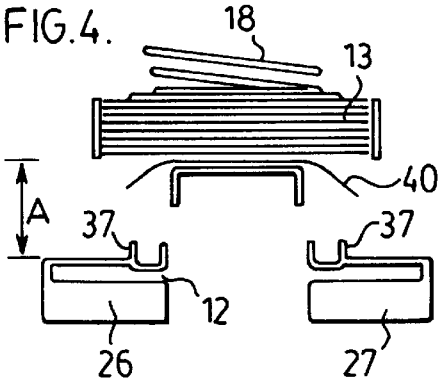
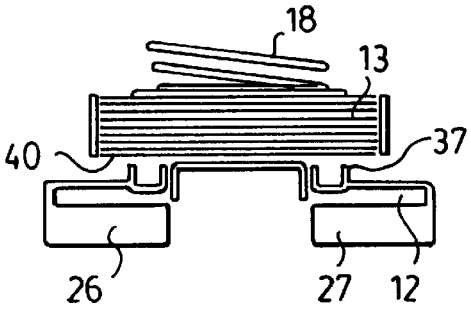
FIG. 5.
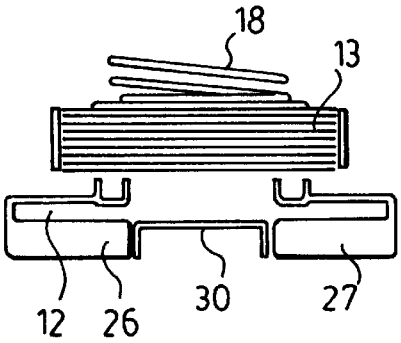
FIG. 6.

CASSETTE FOR STACKING BANKNOTE

FIELD OF THE INVENTION

BACKGROUND OF THE INVENTION

The present invention relates to cassettes for receiving and stacking of banknotes. In particular, the invention relates to cassettes with improved stacking capability.

Existing cassettes for banknote accepting devices such as currency validators or vending devices, include a mechanism for initially receiving a banknote in a guide with a movable actuator positioned between the guides for displacing the banknote laterally to add it to a stack of banknotes adjacent one side of the guides. Typically, this actuator moves the stack of banknotes a sufficient distance for the best banknote to clear the guides. The guides are stationary and aligned with a receiving slot of the cassette. A helical spring bias the banknote in one direction and the movement of the actuator also causes a compression of the spring.

Cassettes of this type require considerable interior space for accommodating movement of the actuator through the stationary guides for stripping of the last received banknote. Furthermore, the actuator must have sufficient power for displacing the stack of banknotes and the spring when a banknote is added to the stack. In many cases, the maximum capacity of the cassette determines the frequency that the cassettes have to be removed and large capacity cassettes are normally desired. On the other hand, space is often at a premium and there is a trade-off between the size of the cassette and the space that is available. Larger capacity cassettes have also required higher power for the actuator as the size of the stack of banknotes which is displaced is also larger.

The present invention provides a structure which more efficiently makes use of the interior volume of the cassette.

SUMMARY OF THE INVENTION

A cassette for receiving banknotes according to the present invention comprises a housing having a slot for longitudinally receiving banknotes between two opposed guides, such that the guides engage opposite sides of a received banknote. A storage arrangement is located to one side of the guides and an actuator is located at the opposite side of the guides. The actuator cooperates with the guides for engaging a banknote received in the guides and moves the received banknote into the storage arrangement. A drive arrangement is connected to the actuator and the guides for causing the guides and the actuator to move a banknote into the storage arrangement by moving the actuator through the guides in one direction as the guides are moved in the opposite direction past the actuator.

According a preferred embodiment of the invention, the drive arrangement includes a rotary cam which controls movement of both the guides and the actuator.

According to yet a further aspect of the invention, the actuator is a platform member which in a banknote receipt position closes one side of the guides and acts as a flat support for a received banknote.

According to yet a further aspect of the invention, the drive arrangement moves the guides in a direction away from the storage arrangement while moving the actuator towards the storage arrangement.

According to yet a further aspect of the invention, the storage arrangement includes a spring unit for providing a spring force urging receiving banknotes maintained in a stack against the stop and allowing movement of such stack of received banknotes to accommodate a new banknote to said stack once the actuator moves through such guides.

According to yet a further aspect of the invention, the stop for the banknote is defined by the guides and is movable with the guides.

The banknote cassette, according to the present invention, comprises a housing defining an enclosure having a slot opening wall thereof through which a banknote can be longitudinally inserted into the cassette. A banknote receiving arrangement is associated with the slot opening and comprises opposed guides in an initial position for engaging the sides of received banknote and a support member in an initial position located between and to one side of said guides. A banknote storage arrangement is located to the side of the guides opposite the initial position of the support member and receives banknotes removed from the guides. A drive arrangement is provided for moving the guides towards the initial position of the support member and for moving of the support member towards the initial position of said guides to remove a received banknote from said guides and to locate the received banknote in the storage area and thereafter return the guides and the support member back to the initial positions.

According to yet a further aspect of the invention, the cassette includes a rotating cam member which controls movement of both the support member and the guides during movement from and return to the initial position.

According to yet a further aspect of the invention, the guides members and the support member each have their own linkage with a cam follow arrangement attached to said cam member with said linkages maintaining said guides and said support arrangement in a generally parallel relationship during movement of the support member through the guides.

BRIEF DESCRIPTION OF THE DRAWINGS

Preferred embodiments of the invention are shown in the drawings, wherein:

FIG. 2 is a simplified view showing the guides and the support arrangement in an initial position for receipt of a banknote;

FIG. 3 shows initial movement of the support arrangement through the guides to start to remove a banknote from the guides;

FIG. 4 shows the relative movement of the support arrangement and the guides freeing the edges of a banknote from the guides;

FIG. 5 shows the guides returning to the initial position;

FIG. 6 shows movement of the support arrangement to the initial position such that the support arrangement and the guides are now positioned for receipt of a banknote;

DETAILED DESCRIPTION OF THE PREFERRED EMBODIMENTS

Figure 1:
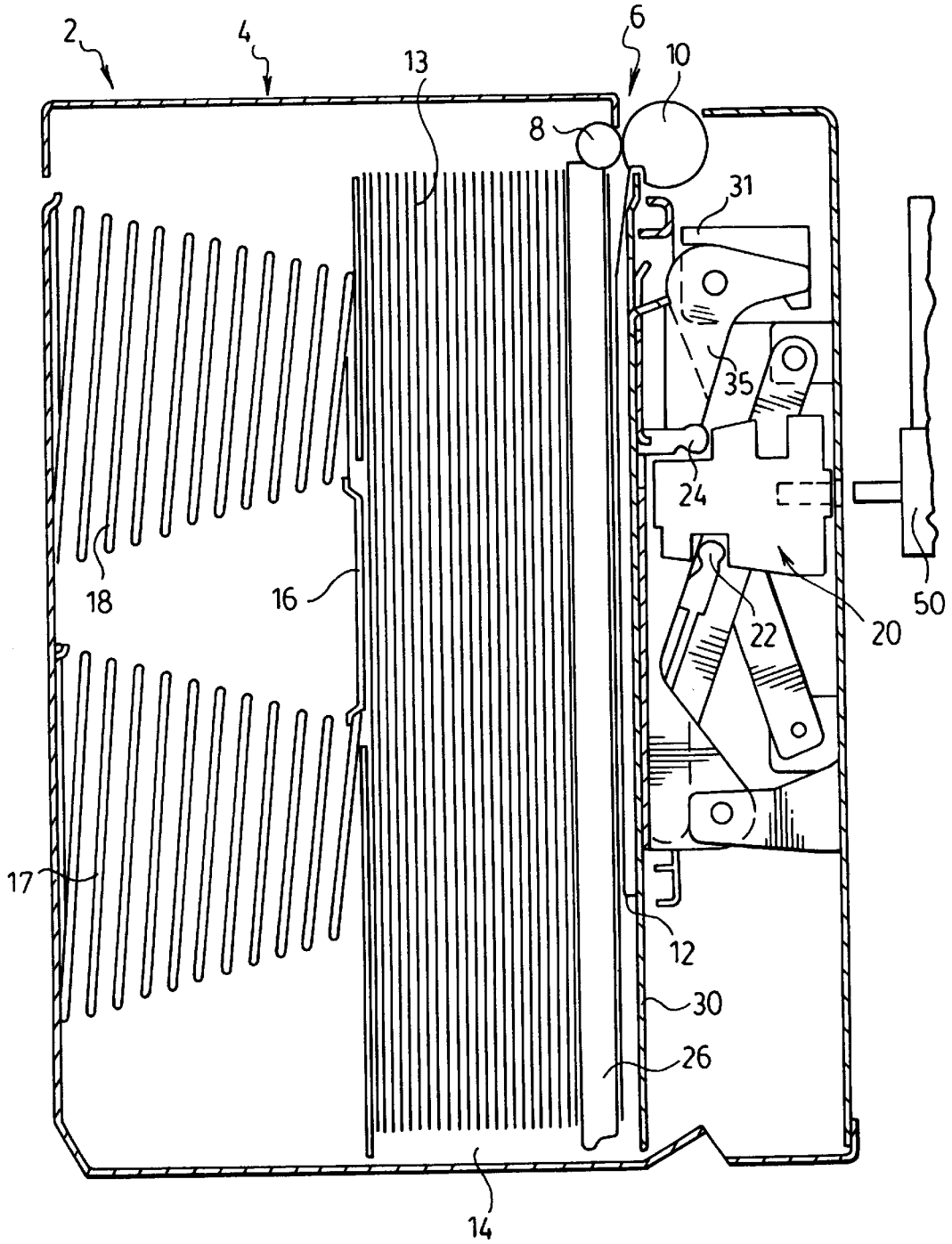
FIG. 1 is a sectional view through the cassette.

The cassette 2 shown in FIG. 1 has a housing 4 with a slot opening 6 for allowing banknotes to enter the cassette. Associated with this slot opening 6 is an idler wheel 8 and a drive wheel 10 which cooperate to engage a banknote and drive it into a banknote slot 12 defined between opposed "U-shaped" guides 26 and 27. Drive wheel 10 and idler wheel 8 are located at the slot opening 6 and drive a received banknote into the guides 26 and 27 without belts.

The cassette to one side of the guides 26 and 27 has a banknote storage area 14 with a stack of banknotes generally shown as 13. A plate 16 is attached to the springs 17 and 18 and generally bias the stack of banknotes 13 against one side of the guide members 26 and 27. A moveable support 30 is located between the opposed guides 26 and 27, and cooperates with the guides to strip a received banknote from the guide members and add it to the stack 13 banknotes.

Movement of the guides 26 and 27 and the support arrangement 30 to cause a banknote to be stripped from the guides is controlled by the rotary cam 20 having an axis of rotation. The rotary cam 20 is secured in the cassette and the cam has continuous two tracks, one for engaging cam follower 22 for causing movement of the guides in a direction generally along the axis of rotation and the second t rack for cam follower 24 attached to the support 30 for moving support 30 in a direction generally along the axis of rotation. This cam allows opposite relative movement of the guides and the support for a superior stripping action.

The FIGS. 2, 3, 4, 5 and 6, show the movement imparted to the guides in the support arrangement for stripping of the banknote. In FIG. 2, the guides 26 and 27 are aligned with the opening slot and have received the banknote 40. The guides 26 and 27 are oversized for receiving banknotes of differing widths. In this case, the depth of the "U-shaped" guides is sufficient for receiving the largest banknote centered in the slot as well as the smallest width banknote centered in the slot. The movable support 30 in FIG. 2 is located to one side of the banknote slot 12 and is positioned intermediary the guides 26 and 27. The guides are in contact with the movable stop 31 controlled by link arm 35. The stop 31 moves to a clear position when link arm 35 pivots, allowing the guides to move past the stop 31.

In FIG. 3, the rotary cam has now caused the support arrangement 30 to move towards the stack of banknotes 13. In this position, the support now forms a stop for the stack of banknotes and the received banknotes are now in contact with the stack.

FIG. 4 shows how the guides 26 and 27 are moved by the cam 20 in a direction away from the stack of banknotes 13 and the received banknote is stripped from the guides. In this way, both the support 30 and the guides 26 and 27 move relative to one another and reduce the amount of space required to strip a banknote 40 from the guides 26 and 27. Furthermore, there is very little displacement of the stack of banknotes to add a banknote to the stack, such that the energy requirements for the stacking operation is reduced and essentially constant, regardless of the size of the stack of banknotes. As shown, the stacked banknotes, during the addition of a received banknote, undergo little displacement and are generally stationary.

The movement of guides 26 and 27 and the support 30 are controlled by the cam. In the embodiment shown, support 30 moves first and guides 26 and 27 move thereafter. Other arrangements are possible to achieve the relative movement therebetween.

FIG. 5 shows how the guides have now been brought back to an initial position and the "U-shaped" stops 37 engage the banknote which has now been stripped from the guides.

FIG. 6 shows how the support member 30 is now moved back to the opposite side of the guides in preparation for receiving of a banknote. The banknote slot 12 is now aligned with the slot 6 in the housing and is in a position for receiving a further banknote.

With the arrangement as described in FIGS. 2 through 6, improved space efficiency is accomplished as the guides move into the space formally occupied essentially by the support 30 and the support 30 moves through the guides to strip a banknote from the guides. The space generally shown as A in FIG. 4, is the maximum amount of space required in the cassette for the relative movements of the guides and support member. This space is less than the space required if the support member was designed to only move relative to fixed guides 26 and 27 which would also require a large shift in the stack of banknotes.

Figure 7:
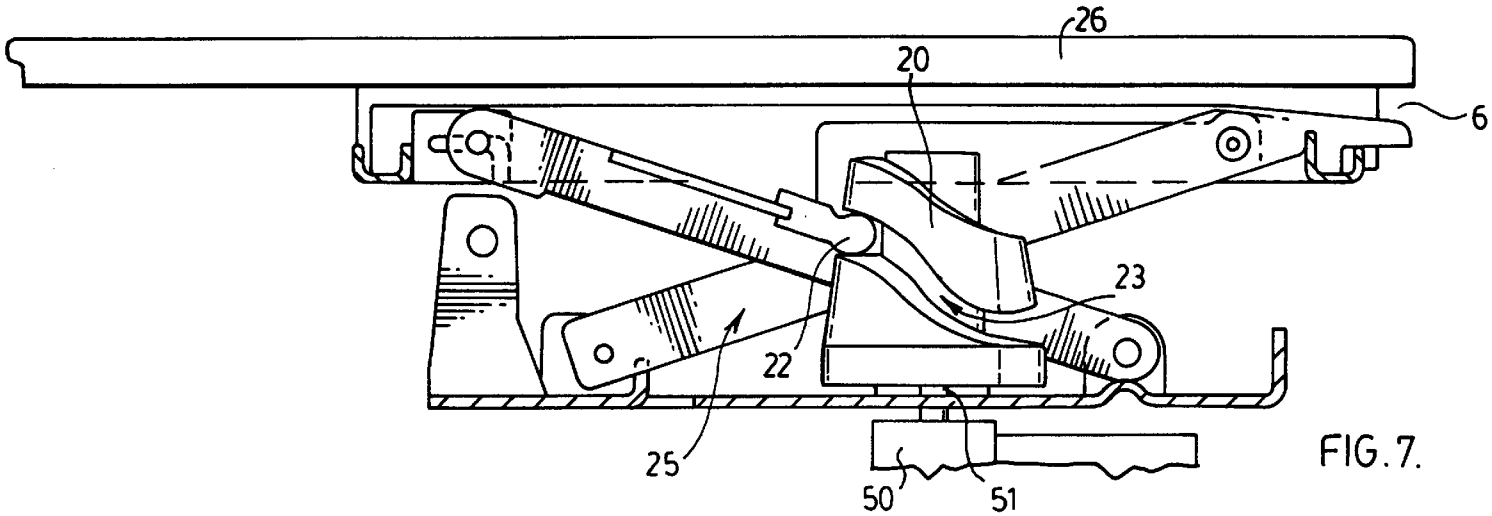
FIG. 7 is a side view showing a cam actuator cooperating with a scissor linkage used to control the guides.

FIG. 7 shows details of the rotary cam 20. The rotary cam is engageable with a motor drive 50 shown in FIG. 1 and causes the cam followers 22 and 24 to impart the desired action to the guides 26 and 27 and the support 30. The motor 50 is part of the device which receives a banknote cassette. FIG. 7 shows the scissor-type arrangement used to move the guides 26 and 27 in the manner described in FIGS. 2 through 6. The cam follower 22 moves within the cam channel 23 and imparts the desired action to the scissor-type linkage arrangement generally shown as 25. The motor shaft 51 drives the rotary cam.

Figure 8:
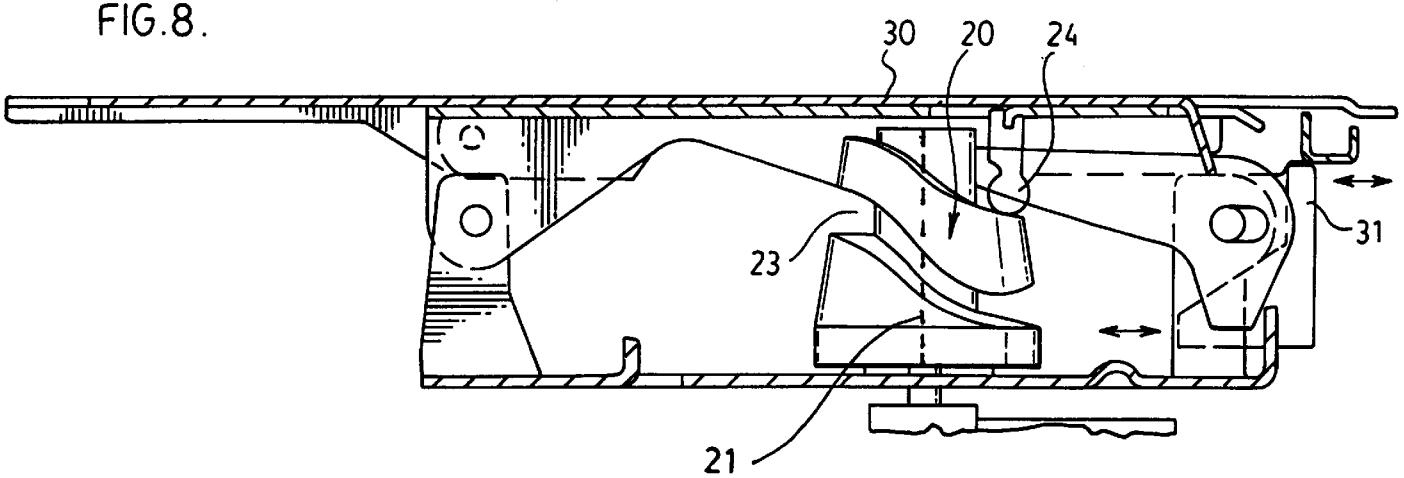
FIG. 8 is a view of the cam drive arrangement as cooperation with a linkage is used to control the support arrangement.
Figure 9:
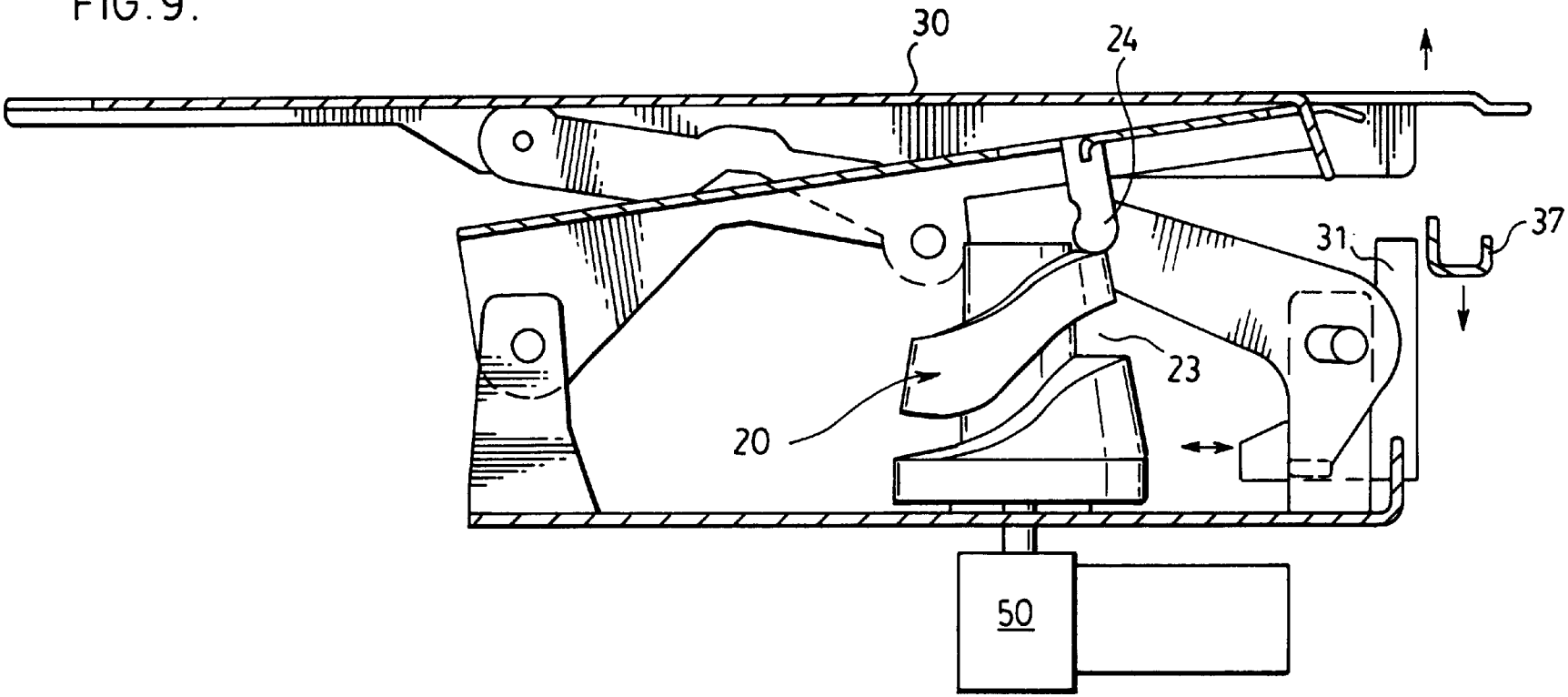
FIG. 9 is a view similar to FIG. 8 with the support arrangement moved to an end position adding the banknote to a stack of banknotes.

FIGS. 8 and 9 illustrate the movement of the support member 30 from the banknote receipt position of FIG. 8 to the extended position for stripping of a banknote from the guides shown in FIG. 9. The support member 30 is spring biased to provide a force maintaining the cam follower 24 in contact with the cam surface 29 at the end of cam member 20.

For a better understanding of the working of the components, the guides 26 and 27 are not shown but would be attached to plate 39. Plate 39 to the right hand side of FIG. 10 has been cut away to show the linkage 25.

The cam 20 has cam followers 22 and 24 located 180° apart relative to the cam and as such cam surface 25 and cam track 23 have a similar profile. The 180° phase difference causes the opposite desired movement. With this arrangement, the size of the cam can be kept smaller. The cam also allows considerate flexibility in importing the desired drive action for the linkages and the timing of these actions including accordation of the linkages. The single cam is driven in a single direction by motor 50 and is cost effective, as well as highly reliable.

With this arrangement, movement of the support 30 in one direction and movement of the guides 26 and 27 in the opposite direction provides more efficient use of the space within the cassette and it also serves to reduce the force necessary to effectively strip a banknote from the guide arrangement. As can be appreciated in the present structure, the guides move away from the stacked banknotes and thus, the extent that the support member has to move and displace the stacked banknotes is reduced and the distance that the stacked banknotes moves, is reduced to approximately the thickness of a banknote. In this way, there is more room in the cassette for storing of banknotes as the amount of space for moving the stack to add a banknote is almost negligible.

Figure 10:
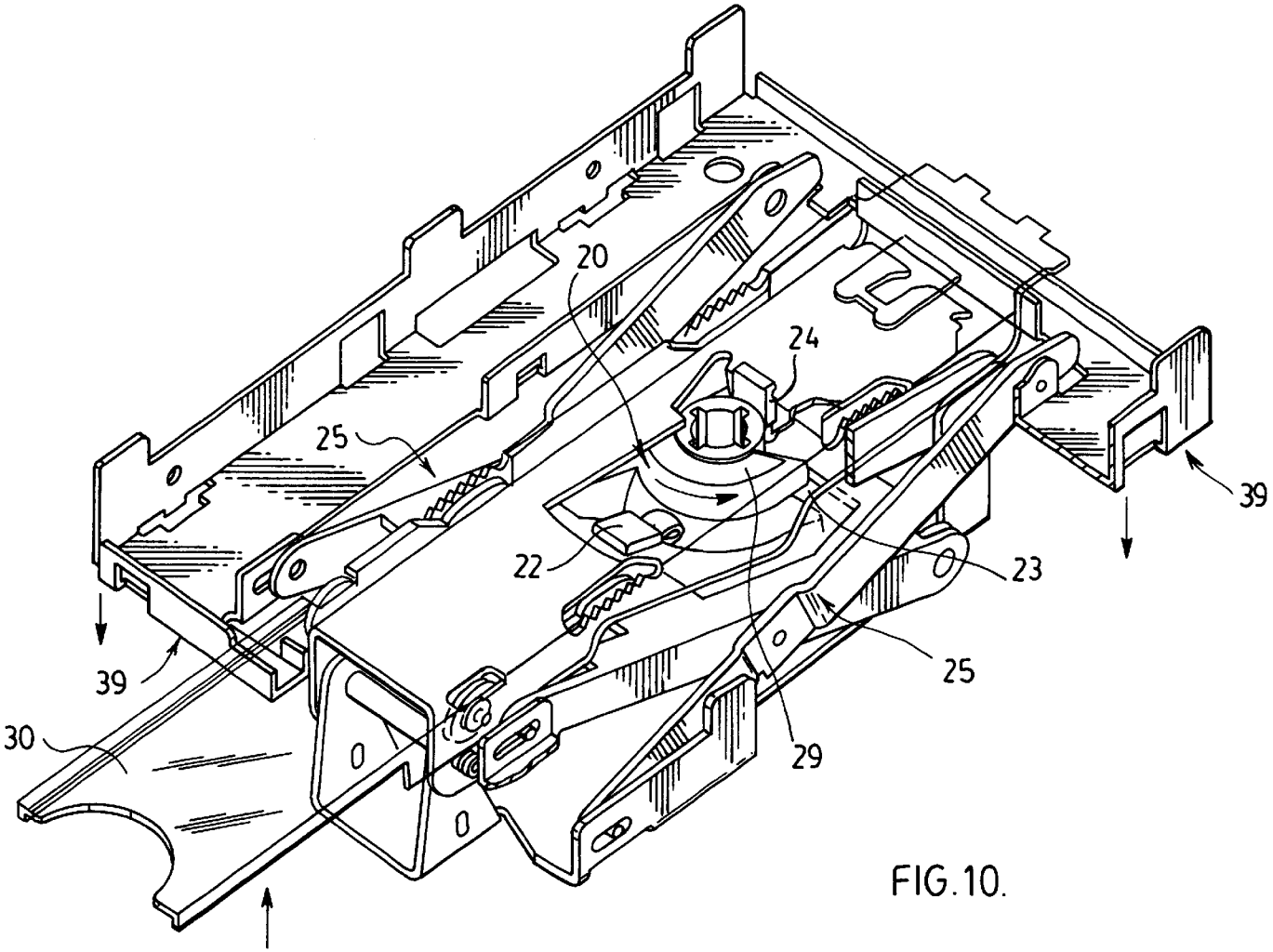
FIG. 10 is a simplified perspective view.

FIG. 10 is a perspective view illustrating the action of the rotary cam controlling support 30 and the guides 26 and 27. Support 30 is shown as a transparent component to illustrate the components therebelow.

Although various preferred embodiments of the present invention have been described herein in detail, it will be appreciated by those skilled in the art, that variations may be made thereto without departing from the spirit of the invention or the scope of the appended claims.

What is claimed is:

1. A cassette for receiving and storing banknotes comprising a housing having a slot opening for longitudinally receiving a banknote, said slot opening being defined by two opposed guides positioned on opposite sides of the received banknote and a support member in an initial position located to one side of the received banknote, said cassette including a storage arrangement to a side of said guides opposite said support member, said storage arrangement receiving therein banknotes displaced from said slot opening to form a stack of banknotes in said storage arrangement, and a drive arrangement for controlled movement of said support member and said guides; said drive arrangement including a rotary cam having an axis of rotation and a first continuous cam track about said axis of rotation for controlling movement of a cam follower associated with said support member as a function of the angular position of said cam and a second continuous cam track for controlling movement of a cam follower associated with said guides as a function of the angular position of said cam, said rotary cam when rotated about said axis of rotation causing said support member to move from said initial position through a gap between said guides partially displacing a received banknote into said storage arrangement and into contact with any banknotes stacked in said storage arrangement and moving said guides from an initial position towards the initial position of said support member to complete the displacement of a received banknote from said slot opening and into said storage arrangement and thereafter returning said guides and said support member to said initial positions.

2. A cassette as claimed in claim 1 wherein said support member and said guides move in a direction generally along the axis of rotation of said rotary cam.

3. A cassette as claimed in claim 1 wherein cam tracks initially cause said support member to move from said initial position through said gap between said guides and thereafter moves said guides towards the initial position of said support member.

4. A cassette as claimed in claim 3 wherein said cam tracks are shaped such that said guides are generally stationary during movement of said support member through said guides and said support member is generally stationary during movement of said guides to said initial position of said support member.

5. A cassette as claimed in claim 1 wherein said support member and said guides cooperate to maintain the general position of the stacked banknotes during the movement of the support member and the guides to displace a received banknote from said slot opening and into said storage arrangement whereby unnecessary movement of any stacked banknotes is reduced.

6. A cassette as claimed in claim 1 wherein said support member in said initial position closes one side of said guides and acts as a flat support for a received banknote and a back face of each guide acts as a stop surface retaining banknotes received in said storage arrangement in a stack pressed against said stop surfaces.

7. A cassette as claimed in claim 6 wherein said storage arrangement includes a spring unit for providing a spring bias urging received banknotes to be maintained in a stack and allows movement of said stack of received banknotes to accommodate a new banknote to said stack when said support member moves through said guides.

8. A cassette as claimed in claim 1 wherein said guides and said support member have a common stop arrangement aligned with said slot opening for defining a banknote receipt position whereby the relationship of said guides and said support member is consistent when said guides and said support member are in said banknote receipt position.

9. A banknote cassette comprising a housing defining an enclosure having a slot opening in a wall thereof through which a banknote can be longitudinally inserted into said cassette, a banknote receiving arrangement associated with said slot opening comprising opposed guides in an initial position for engaging the sides of a received banknote and a support member in an initial position located between and to one side of said guides, a banknote storage arrangement located to the side of said guides, opposite the initial position of said support member with said storage arrangement being open in a gap between said guides, said banknote storage arrangement receiving banknotes removed from said guides, a cam drive arrangement for controlled movement of said guides and said support member, said cam drive arrangement when initiated moving said support member towards said storage arrangement through a, gap between said guides bringing a banknote received between said guides into contact with any banknotes stacked in said storage arrangement, said cam drive arrangement subsequently moving said guides away from said storage arrangement towards said initial position of said support member causing a received banknote to be stripped from said guides and added to banknotes stacked in said banknote storage arrangement with said stacked banknotes being held in a generally stationary position during movement of said support member and said guides to add a received banknote to any banknotes stacked in said storage arrangement, said drive arrangement thereafter returning said guides and said support member back to said initial positions; and wherein said cam drive arrangement includes a rotating cam member having an axis of rotation and two separate cam surfaces with one cam surface controlling movement of said support member in a direction along said axis of rotation and the other cam surface controlling movement of said guides in a direction along said axis of rotation.

10. A banknote cassette as claimed in claim 9 wherein said cam surfaces are a first continuous cam track controlling movement of said support member and a second continuous cam track controlling movement of said guides with each cam track encircling said axis of rotation of said rotary cam, each cam track being shaped to maintain during a first segment of one revolution of said cam said support member stationary as said guides are moved and during a second segment of one revolution of said cam, maintaining said guides stationary as support member is moved.

11. A banknote cassette as claimed in claim 10 wherein said support member includes a spring bias for maintaining a cam follower of said support member in contact with said first continuous cam track.

12. A banknote cassette as claimed in claim 11 wherein said guides include a cam follower in engagement with said second continuous cam track and said second continuous cam track is a cam groove provided in a sidewall of said rotary cam.

13. A banknote cassette as claimed in claim 12 wherein each of said cam followers are moved by said rotary cam in a direction along the axis of rotation of said rotary cam.

14. A banknote cassette as claimed in claim 13 wherein said cam follower of said support member is associated with a scissor mechanism which moves said support member as a function of the movement of said associated cam follower.

15. A banknote cassette as claimed in claim 14 wherein said cam follower of said guides is associated with a scissor mechanism which moves said guides as a function of the movement of said associated cam follower.

* * * * *